US007137833B2

(12) United States Patent
Woodward

(10) Patent No.: US 7,137,833 B2
(45) Date of Patent: Nov. 21, 2006

(54) COMPRESSION QUICK CONNECT/DISCONNECT ROTATING LUG TERMINAL

(75) Inventor: Jerry Allen Woodward, Collierville, TN (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 11/060,027

(22) Filed: Feb. 17, 2005

(65) Prior Publication Data

US 2005/0191883 A1 Sep. 1, 2005

Related U.S. Application Data

(60) Provisional application No. 60/548,751, filed on Feb. 27, 2004.

(51) Int. Cl.
*H01R 25/00* (2006.01)

(52) U.S. Cl. ..... 439/115

(58) Field of Classification Search ..... 439/115, 439/881, 845, 850, 810, 91, 92, 814; 29/874; 174/84 C, 94 R See application file for complete search history.

(56) References Cited

U.S. PATENT DOCUMENTS

| | | | | |
|---|---|---|---|---|
| 2,740,101 | A | 3/1956 | Betts | |
| 2,945,206 | A | 7/1960 | Hammell | |
| 4,050,769 | A | 9/1977 | Ammon | |
| 4,080,041 | A | 3/1978 | Hawkins, Jr. | |
| 4,210,382 | A | 7/1980 | Culbertson | |
| 4,298,243 | A | 11/1981 | Swengel, Jr. et al. | |
| 4,552,430 | A | 11/1985 | Myers | |
| 4,693,688 | A | 9/1987 | Cembruch et al. | |
| 4,771,538 | A | 9/1988 | O'Loughlin et al. | |
| D302,542 | S | 8/1989 | O'Loughlin | |
| 4,911,660 | A | 3/1990 | Alf et al. | |
| 5,181,867 | A | 1/1993 | Rodondi et al. | |
| 5,203,726 | A | 4/1993 | Quinn | |
| 5,217,391 | A * | 6/1993 | Fisher, Jr. | 439/578 |
| 5,378,870 | A * | 1/1995 | Krupnicki | 219/137.63 |
| 5,533,916 | A | 7/1996 | Newman et al. | |
| 5,624,287 | A | 4/1997 | Newman et al. | |
| 5,681,191 | A | 10/1997 | Robicheau et al. | |
| 6,043,433 | A | 3/2000 | Schweitzer, Jr. | |
| 6,283,771 | B1 * | 9/2001 | Mitchell et al. | 439/95 |
| 6,573,450 | B1 | 6/2003 | Saito et al. | |
| 6,609,921 | B1 * | 8/2003 | Rehrig | 439/191 |

* cited by examiner

*Primary Examiner*—Alexander Gilman
(74) *Attorney, Agent, or Firm*—Hoffmann & Baron, LLP

(57) ABSTRACT

An electrical connector assembly that includes a lug connector having a flat end with a flat end connector and a barreled end having a barrel connector and an angle connector that includes a body having a male pin and a compression fitting. The male pin is rotatably inserted into the barrel connector. After the orientation of the angle connector is selected, the barrel connector is compressed to mechanically and electrically engage the first male pin. The compression fittings of the angle connector can be sized to connect wires or cables from #8 AWG to 3000 kcmil in size. In preferred embodiments, the flat end and the barreled end of the lug connector are angularly disposed to each other and form an angle of between 60 and 150 degrees.

15 Claims, 5 Drawing Sheets

COMPRESSION QUICK CONNECT/DISCONNECT ROTATING LUG TERMINAL

This application claims priority from provisional application Ser. No. 60/548,751, filed on Feb. 27, 2004.

BACKGROUND OF INVENTION

The present invention relates to connectors for heavy gauge wires and cables that are used when a confined space does not easily allow the wires/cables to be bent. The angle connectors of the present invention combine angle connectors with a variety of different lug connectors to allow wire/cable bends to be made in various orientations when space is limited.

When installing heavy gauge wires/cables, it is often necessary to bend the wires/cables to make a connection. However, the physical characteristics of heavy gauge wires/cables limit the radius of the bend that can be made. In some cases, lug connectors (also sometimes referred to as flag connectors) are used to make tight bends with heavy gauge wires/cables that cannot be easily bent. U.S. Pat. No. D302,542 to O'Loughlin and U.S. Pat. No. 4,771,538 to O'Loughlin et al. provide examples of different lug connectors that are presently in use. (Both of these patents are incorporated herein in their entirety by reference.) The drawback of these connectors is that they have a fixed orientation and can only accommodate wires/cables coming from a limited number of different directions. Accordingly, there is a need for a more flexible lug-type connector that can connect wires/cables that are oriented over a 360 degree range and at different angles to each other.

SUMMARY OF THE INVENTION

The present invention relates to an electrical connector assembly that includes a lug connector that includes a flat end having a flat end connector with at least one aperture and a barreled end having a barrel connector; and an angle connector that includes a body having a plurality of different surfaces, a first male pin and a first compression fitting. The barrel connector rotatably accommodates the first male pin to mechanically and electrically connect the lug connector and the angle connector. After the orientation of the angle connector is selected, the barrel connector is compressed to mechanically and electrically engage the first male pin. In a preferred embodiment, the first male pin and the first compression fitting are on different surfaces about 90 degrees apart. In another embodiment, the flat end of the lug connector is angularly disposed to the barreled end to permit wires/cables coming from different directions to be connected.

In another preferred embodiment of the electrical connector assembly of the present invention, the body of the angle connector is at least partially coated with electrically insulating material to prevent accidental electrical grounding of the connector. The compression fittings of the angle connector can be sized to connect wires or cables from #8 AWG to 3000 kcmil in size. In preferred embodiments, the compression fittings include a beryllium contact ring. The angle connector of the electrical connector assembly can also include either a second male pin, a second compression fitting or both. Preferably, the first and second compression fittings and/or the first and second male pins are on different surfaces and are about 180 degrees apart.

In preferred embodiments of the electrical connector assembly, the lug connector has a longitudinal axis extending from the flat end to the barrel connector end and the flat end and the barreled end are angularly disposed to each other and form an angle of between 60 and 150 degrees. In preferred embodiments, the flat end and the barreled end are angularly disposed to each other and form an angle of about 90 or 135 degrees. This is the interior angle between the flat end and the barrel end. Typically, the lug connectors are described in terms of the exterior or supplementary angle so that a lug connector with a 135 degree interior angle is referred to as a 45-degree lug connector. For a lug connector with a 90 degree interior angle, the exterior angle is also 90 degrees.

The present invention also provides a kit of parts for an electrical connector assembly which includes an angle connector having a body, a male pin and a compression fitting; and a plurality of lug connectors having a barrel portion and a flat connection end. The barrel portion of each lug connector is adapted to insertably accommodate the male pin for mechanical and electrical engagement between the lug connector and the angle connector. In addition, the flat connection ends of each of the lug connectors extend at mutually distinct angles from the barrel portions.

BRIEF DESCRIPTION OF THE FIGURES

Other objects and many attendant features of this invention will be readily appreciated as the invention becomes better understood by reference to the following detailed description when considered in connection with the accompanying drawings wherein.

DETAILED DESCRIPTION OF THE INVENTION

Figure 1:
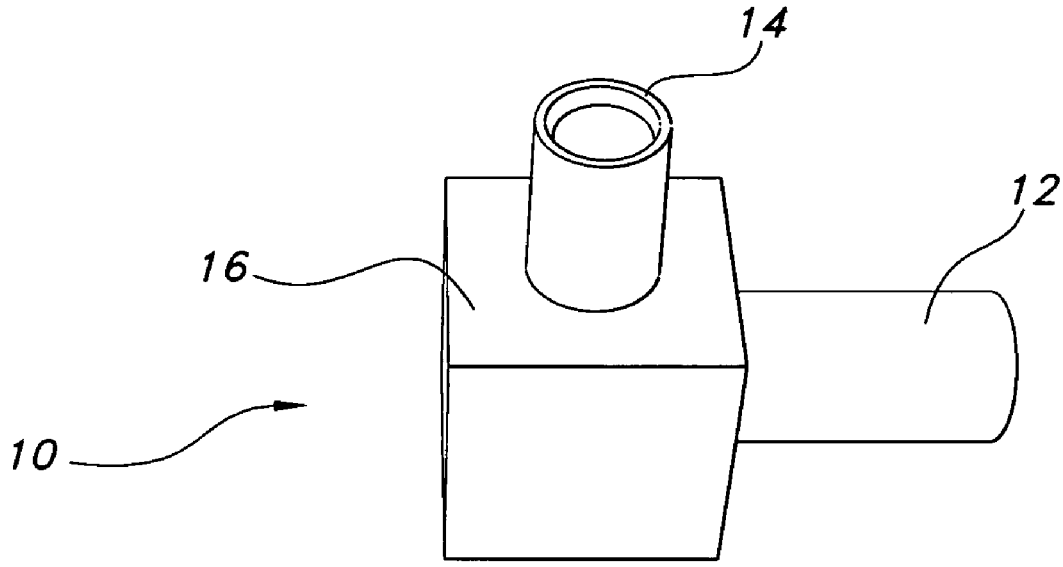
FIG. 1 shows a angle connector with one male connection and one compression fitting.

The connector assemblies of the present invention provide for easy and efficient connection of two or more wires/cables and are comprised of an angle connector, preferably with 90-degree or 180-degree connections, and at least one lug connector. The term lug connector is well know to those skilled in the art and refers to connectors that include a lug connection and a barrel-type compression fitting connection in various configurations. The connections for the angle connectors of the present invention can vary in size according to the size of the wires/cables that are being connected. The angle connectors have two or more connections which are preferably 90 degrees apart. In the most preferred embodiments, the angle connector has at least one connection which is a compression fitting connection. However, the angle connectors can have as many as six connections which can be made up of any combination of male pin connections and compression fitting connections.

The angle connectors are constructed of an electrically conductive metal such as copper or aluminum and can be plated with a material known by those skilled in the art for plating electrical devices, such as tin. The size of the angle connectors can vary according to the size of the wires/cables that are to be connected. For examples, large size wires/cables, which are used in high voltage applications, require larger angle connectors. The angle connectors are preferably shaped like a block but the connectors are not limited to a particular shape and cylindrically-shaped connectors are within the scope of the present invention. In the most preferred embodiments, the compression fittings are provided with multi-louvered beryllium contact rings (not shown in the figures) as the contact interface. In other preferred embodiments, the angle connectors are at least partially coated with an electrically insulating material (not shown). This prevents the creation of an electrical path between the angle connector and any metal surface that may contact it.

Typically, the angle connectors have six surfaces and the connections are preferably made on adjoining surfaces to provide a 90 degree connection between the wires/cables. A preferred embodiment includes at least one male pin connection and at least one compression fitting connection. However, the angle connectors can have any combination of male pin connections and compression fitting connections or the angle connectors can include all male pin connections or all compression fitting connections. The male pin connections and compression fitting connections vary in size so that they can be connected to different size wires/cables from #8 AWG to 3000 kcmil in size. In addition, the male pin connections and the compression fitting connections can all be the same size or an angle connector can have as many as six male pin and/or compression fitting connections which are the same size or a combination of different sizes.

The lug connectors used in the present invention typically include a flat end with one or more apertures for connecting the lug connector to an electrically conductive structure and a barrel end with a barrel connection which is compressively attached to a male pin connection. The lug connector is constructed from an electrically conductive metal, preferably copper or aluminum, and it may be plated with a metal such as tin. The size of the lug connector is selected by the user based on the specific application. Typically, high voltage application which use large size wires/cables require the use of larger lug connectors. The selection of the size lug connector required for an application would be within the knowledge of one of ordinary skill in the art.

In preferred embodiments, the barrel end is angularly disposed to the flat end so that the longitudinal axis of the barrel connector forms an angle with the flat end. For the purposes of the present invention, the "angle" of the lug connector refers to the angle between the barrel end and a flat surface when the flat end is flush with the flat surface. For example, FIG. 9B shows a straight lug connector where the barrel end is flush with the flat surface and the angle is 0 degrees. When the barrel end of the lug connector is angularly disposed, the barrel end forms an angle with the flat surface. For example, FIG. 11B shows the barrel end forming a 45-degree angle with the flat surface and FIG. 12B shows the barrel end forming a 90-degree angle with the flat surface. The angle of the lug connectors is not limited to a specific range and the only constraint is the physical limitations. However, the preferred angle connectors have angles of from about 30 to about 120 degrees, and the most preferred embodiments have angles of from about 45 to about 90 degrees. When the lug connector is connected to an angle connector to form the connector assembly of the present invention, the selection of either a straight or angularly disposed lug connector provides numerous configurations for connecting wires/cables with different orientations.

Referring to FIG. 1, a preferred embodiment of the present invention is shown, wherein angle connector 10 includes a metal body 16 with six surfaces having a male pin connection 12 and a compression fitting connection 14. The male pin connection 12 and the compression fitting connection 14 extend outwardly from adjoining surfaces of the metal body 16 at an angle of about 90 degrees to each other. The size of the male pin connection 12 and the size of the compression fitting connection 14 can vary in order to accommodate wires and cables of various sizes.

Figure 2:
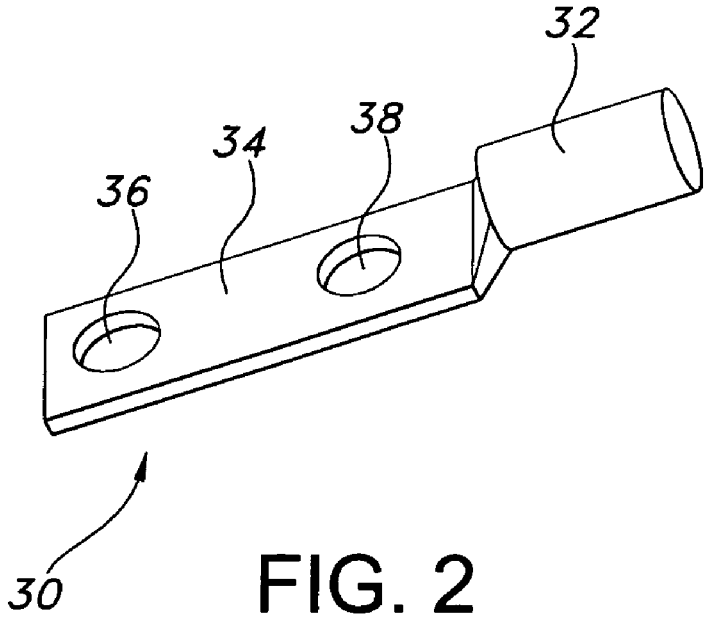
FIG. 2 is a perspective view of a lug connector with a compression fitting.

FIG. 2 shows a lug connector 30 which includes a flat end 34 with apertures 36, 38 and a barrel end connection 32. The flat end 34 can be connected to a metal structure with bolts or screws (not shown) which are inserted through the apertures 36, 38 and then tightened to electrically contact the metal structure with the lug connector 30. The barrel end connection 32 can be compressively connected to a male pin connection using a crimping tool.

Figure 3:
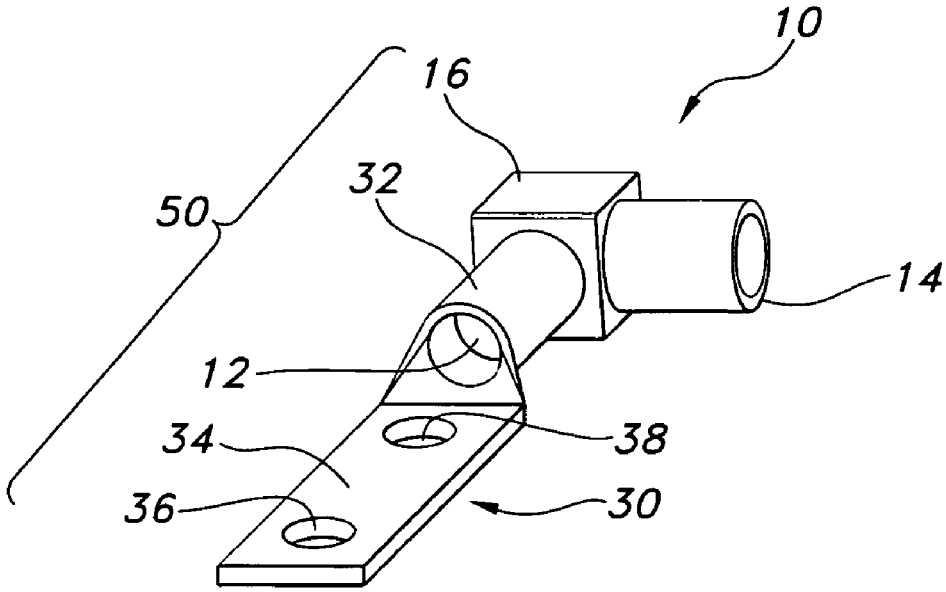
FIG. 3 is a perspective view of a connector assembly with an angle connector and a lug connector.

FIG. 3 shows an embodiment of the connector assembly 50 of the present invention where the male pin connection 12 of the angle connector 10 shown in FIG. 1 is inserted into the barrel end connection 32 of the lug connector 30 shown in FIG. 2. Before the barrel end connection 32 is compressively affixed to the male pin connection 12, the angle connector 10 can be rotated 360 degrees. This allows the compression fitting connection 14 to be connected to a wire/cable coming from any direction. Connectors presently being used do not have this flexibility.

Figure 4:
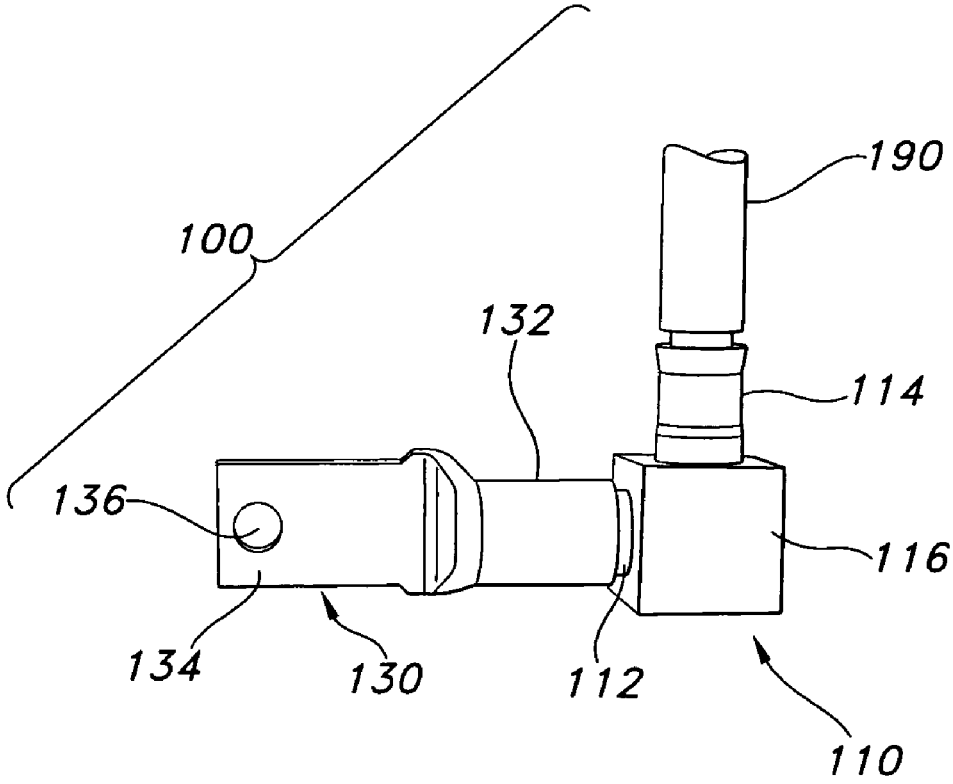
FIG. 4 shows a connector assembly with the angle connector attached to a wire.

FIG. 4 shows an embodiment of a preferred connector assembly 100 of the present invention. The connector assembly 100 includes an angle connector 110 and a lug connector 130. The angle connector 110 includes a male pin connector 112 and a compression fitting connection 114 which are 90 degrees apart. The lug connector 130 includes a compressive barrel end connection 132 and a flat end 134 which has one aperture 136 for electrically connecting the lug connector 130 to an electrically conductive structure using an electrically conductive bolt or screw. The male pin connector 112 is inserted into the barrel end 132 of the lug connector 130 and the angle connector 110 is rotated until the compression fitting connection 114 is in the proper position for receiving the wire/cable 190. The barrel end connection 132 is then compressed to attach the lug connector 130 to the angle connector 110 and to form an electrically conductive path between them.

The angle connector 110 is selected so that the size of the male pin connector 112 corresponds to the barrel connection 132 of the lug connector 130 and so that the compression fitting connection 114 matches the size of the wire/cable 190. After the male pin connection 112 is inserted into the barrel connection 132, the angle connector can be rotated 360 degrees to provide different orientations. After the orientation is selected to accommodate the wire/cable 190, the barrel 132 is compressed to electrically and fixedly attach the lug connector 130 to the angle connector 110. The wire/cable 190 is then inserted into the compression fitting connection 114 and the fitting is compressed (also referred to as "crimped") to secure the wire/cable 190 in place and to form an electrically conductive path between the wire/cable 190 and the flat end 134 of the lug connector 130.

Figure 5:
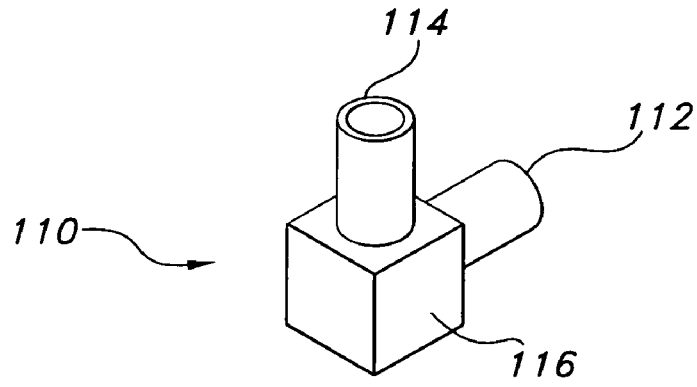
FIG. 5 shows an angle connector having one male connection and one compression fitting.

FIG. 5 shows an angle connector 110 having a cube-shaped body 116 with six surfaces, a male pin connection 112 and a compression fitting connection 114. The present invention is not limited to cube-shaped bodies and triangularly-shaped bodies (with five surfaces and connections separated by 60 and/or 120 degrees) or cylindrically-shaped bodies (where the connections can be separated from 0 to 180 degrees), as well as other shapes are contemplated by the present invention. The body can also be elongated in order to accommodate two or more connections on one surface.

Figure 6:
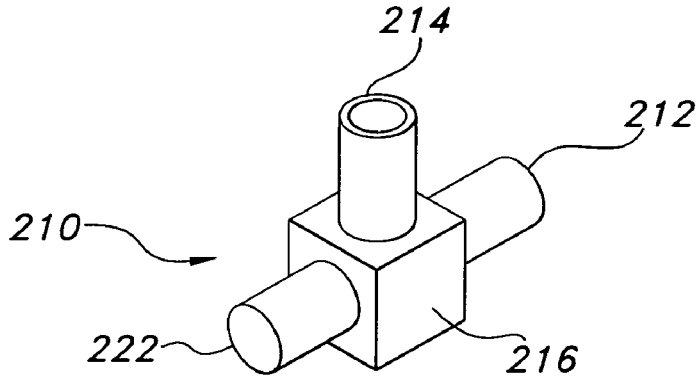
FIG. 6 shows an angle connector having two male connections and one compression fitting.

FIG. 6 shows an angle connector 210 having a cube-shaped body 216, two male pin connections 212 and 222 and a compression fitting connection 214. In another embodiment of the present invention, instead of a second male pin connection 222, the angle connector 210 can have a second compression fitting connection (not shown). Other embodiments of the invention can have three male pin connections or three compression fitting connections (not shown).

Figure 7:
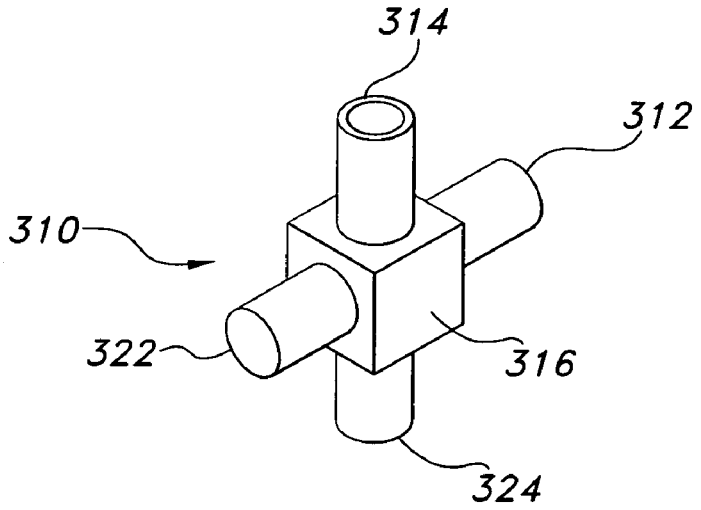
FIG. 7 shows an angle connector having three male connections and one compression fitting.

FIG. 7 shows an angle connector 310 having a cube-shaped body 316, two male pin connections 312, 322 and two compression fitting connections 314, 324. Other embodiments of the angle connector can have all male connections, all compression fitting connections or any combination of male connections and compression fitting connections for the four connections (not shown). A further embodiment of the angle connector has connections on all six surfaces of the cube-shaped body (not shown). These connections can be any combination of male pin connections and compression fitting connections.

Figure 8A:
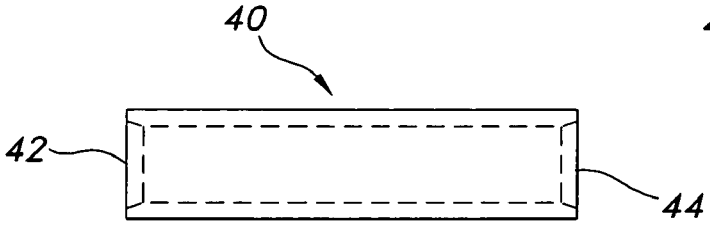
FIG. 8A and FIG. 8B show a side and an end view, respectively, of a splice connector.
Figure 8B:
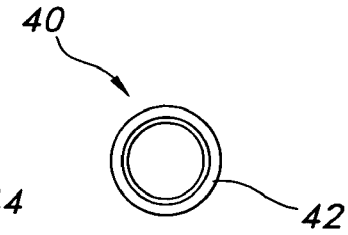

FIGS. 8A and 8B show a two-way splice connector 40 that can be connected to a mail pin connection 12 on an angle connector 10 (FIG. 1) or to a wire/cable. The splice connector 40 has a compressible barrel connector on each end 42, 44. In a preferred embodiment, a male pin connection 12 of an angle connector 10 (FIG. 1) is inserted into one end 42 of the splice connector 40 and a wire/cable is inserted into the opposing end 44 (FIGS. 8A, B). The two ends 42, 44 are then compressed to securely attach the male pin connection 12 (FIG. 1) to the wire/cable and form an electrically conductive connection between the angle connector and the wire/cable (not shown).

Figure 9A:
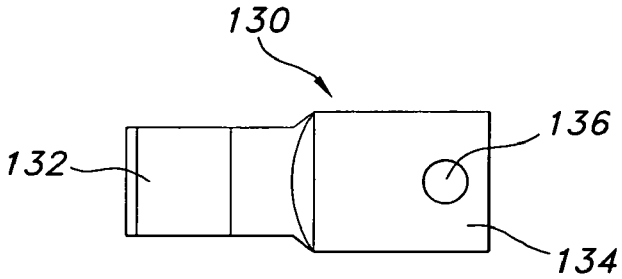
FIG. 9A and FIG. 9B show a top and an end view, respectively, of a lug connector with one aperture in the flat end.
Figure 9B:
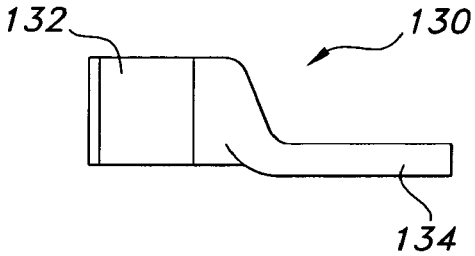

FIGS. 9A and 9B show a straight lug connector 130 wherein the longitudinal axis of the barrel end connection 132 and the longitudinal axis of the flat end 134 are parallel to each other. The lug connector 130 has an aperture 136 in the flat end 134 through which a bolt or screw (not shown) can be inserted for attaching the lug connector 130 to an electrically conductive metal structure.

Figure 10A:
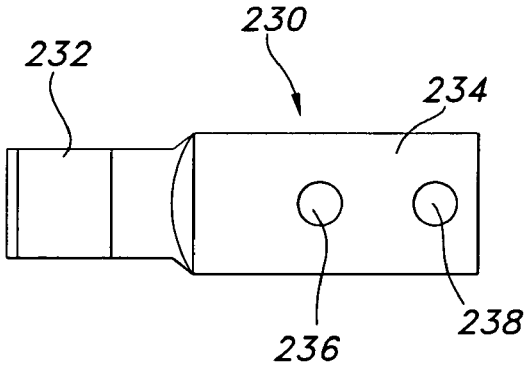
FIG. 10A and FIG. 10B show a top and an end view, respectively, of a lug connector with two apertures in the flat end.
Figure 10B:
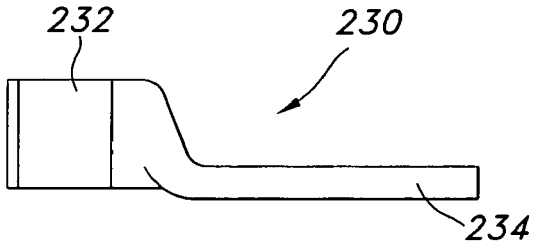

FIGS. 10A and 10B show a lug connector 230 having a barrel end connection 232 and a flat end 234, which is similar to the lug connector 130 in FIGS. 9A and 9B, except the flat end 234 includes two apertures 236, 238 for attaching the lug connector 230 using either bolts or screws. A connector assembly 50 of the present invention is formed by inserting a male pin connection 12 of an angle connector 10 (see FIG. 3) into a barrel end connection 232.

Figure 11A:
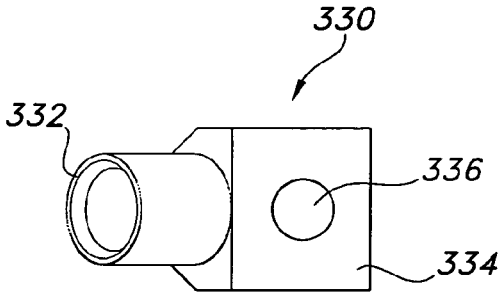
FIG. 11A and FIG. 11B show a top and an end view, respectively, of a 45-degree lug connector with one aperture in the flat end.
Figure 11B:
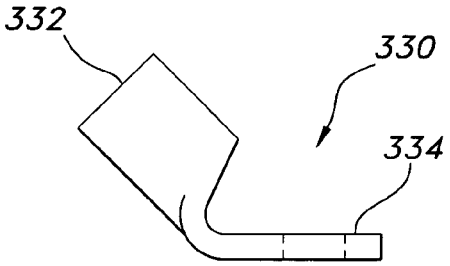

FIGS. 11A and 11B show a lug connector 330 having a barrel end connection 332 and a flat end 334, wherein the longitudinal axis of the barrel end connection 332 forms an angle of about 45 degrees with the longitudinal axis of the flat end 334. The lug connector 330 has an aperture 336 in the flat end 334 through which a bolt or screw (not shown) can be inserted for attaching the lug connector 330 to an electrically conductive metal structure.

Figure 12A:
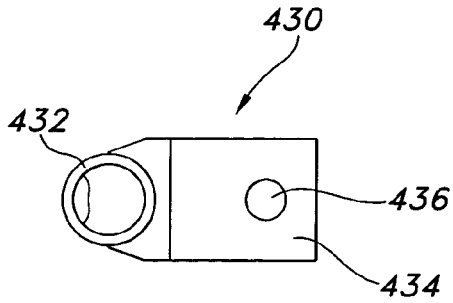
FIG. 12A and FIG. 12B show a top and an end view, respectively, of a 90-degree lug connector with one aperture in the flat end.
Figure 12B:
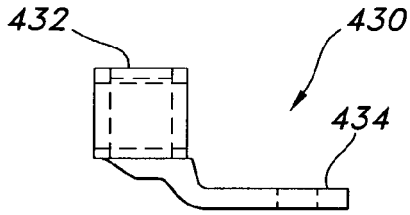

FIGS. 12A and 12B show a lug connector 430 having a barrel end connection 432 and a flat end 434, which is similar to the lug connector 330 in FIGS. 11A and 11B, except the longitudinal axis of the barrel end connection 432 forms an angle of about 90 degrees with the longitudinal axis of the flat end 434.

Figure 13A:
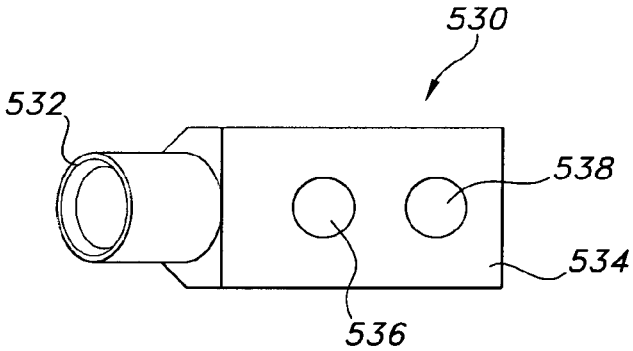
FIG. 13A and FIG. 13B show a top and an end view, respectively, of a 45-degree lug connector with two apertures in the flat end.
Figure 13B:
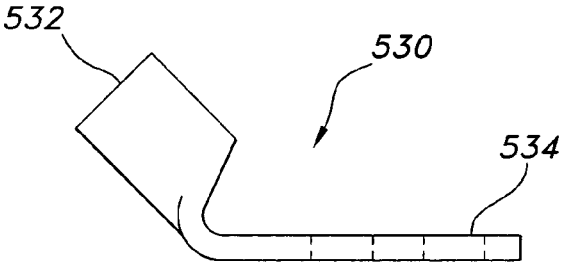

FIGS. 13A and 13B show a lug connector 530 having a barrel end connection 532 and a flat end 534, wherein the longitudinal axis of the barrel end connection 532 forms an angle of about 45 degrees with the longitudinal axis of the flat end 534. The lug connector 530 has two apertures 536, 538 in the flat end 534 through which bolts or screws (not shown) can be inserted to attach the lug connector 530 to an electrically conductive metal structure.

Figure 14A:
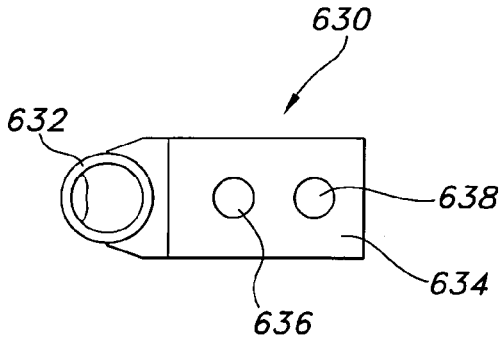
FIG. 14A and FIG. 14B show a top and an end view, respectively, of a 90-degree lug connector with two apertures in the flat end.
Figure 14B:
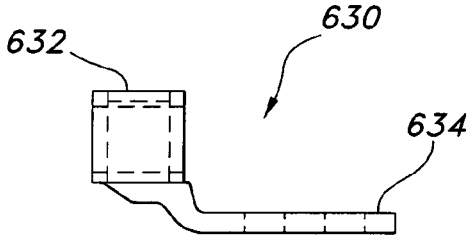

FIGS. 14A and 14B show a lug connector 630 having a barrel end connection 632 and a flat end 634, which is similar to the lug connector 530 in FIGS. 13A and 13B, except the longitudinal axis of the barrel end connection 632 forms an angle of about 90 degrees with the longitudinal axis of the flat end 634.

The connector assemblies of the present invention provide a variety of different connector orientations by combining one of the angle connectors 110, 210, 310 shown in FIGS. 5–7 with one or more of either the splice connector 40 shown in FIGS. 8A, B or the lug connectors 130, 230, 330, 430, 530, 630 shown in FIGS. 9A, B–FIGS. 14A, B. After the male pin connection 112, 212, 222, 312, 322 of the angle connector 110, 210, 310 is inserted into an end 42, 44 of a splice connector 40 or a barrel end connection 132, 232, 332, 432, 532, 632 of a lug connector 130, 230, 330, 430, 530, 630, the angle connector 110, 210, 310 can be rotated to the desired orientation and then secured in place by compressing the splice connector end 42, 44 or the barrel end connection 132, 232, 332, 432, 532, 632.

The lug connectors 130, 230, 330, 430, 530, 630 are made from an electrically conductive metal, preferably copper or aluminum, and preferably the same material as the angle connectors 110, 210, 310. In preferred embodiments, the lug connectors 130, 230, 330, 430, 530, 630 have a barrel connection 132, 232, 332, 432, 532, 632 on one end which connects to the male pin connection of 112, 212, 222, 312, 322 of the angle connector 110, 210, 310. One or more of the splice connectors 40 or lug connectors 130, 230, 330, 430, 530, 630 can be used with the angle connectors 110, 210, 310 to form the connector assemblies of the present invention. For example, the angle connector 310 shown in FIG. 7 has two male pin connections 312, 322 which can be connected to two lug connectors 130, 230, 330, 430, 530, 630 shown in FIGS. 9A, B–14A, B. The two compression fitting connections 314, 324 of the angle connector 310 can also be used to connect wires/cables. This provides a multitude of choices and flexibility for the user.

For a specific application, a user forms a connector assembly of the present invention by selecting one of the angle connectors 110, 210, 310 shown in FIGS. 5–7 and at least one of the lug connectors 130, 230, 330, 430, 530, 630 shown in FIGS. 9A, B–FIGS. 14A, B. The angle connector 110, 210, 310 and the lug connectors 130, 230, 330, 430, 530, 630 are selected based on the number and size of the wires/cables that are being connected and their orientation in relation to each other. The numerous combinations of angle connectors and lug connectors makes it easy and convenient for the user to connect wires/cables in confined spaces.

Thus, while there have been described the preferred embodiments of the present invention, those skilled in the art will realize that other embodiments can be made without departing from the spirit of the invention, and it is intended to include all such further modifications and changes as come within the true scope of the disclosure set forth herein.

I claim:

1. An electrical connector assembly comprising:

a lug connector comprising a flat end having a flat end connector with at least one aperture and a barreled end having a barrel connector; and an angle connector comprising a body having six substantially flat surfaces for connections with at least two of the surface being in orthogonal relationship, a first male pin and a first compression fitting extending from the at least two surfaces;

wherein the barrel connector rotatably accommodates the first male pin and is compressed to mechanically and electrically engage the first male pin and connect the lug connector and the angle connector.

2. An electrical connector assembly according to claim 1, wherein the first male pin and the first compression fitting are on different surfaces about 90 degrees apart.

3. An electrical connector assembly according to claim 1, wherein the flat end is angularly disposed to the barreled end.

4. An electrical connector assembly according to claim 1, wherein the body of the angle connector is at least partially coated with electrically insulating material.

5. An electrical connector assembly according to claim 1, wherein the first compression fitting comprises a beryllium contact ring.

6. An electrical connector assembly according to claim 1, wherein first compression fitting connects to wires or cables from #8 AWG to 3000 kcmil in size.

7. An electrical connector assembly according to claim 1, wherein the lug connector has a longitudinal axis extending from the flat end to the barrel connector end and wherein the flat end and the barreled end are angularly disposed to each other and form an angle of between 60 and 150 degrees.

8. An electrical connector assembly according to claim 1, wherein the lug connector has a longitudinal axis extending from the flat end to the barrel connector end and wherein the flat end and the barreled end are angularly disposed to each other and form an angle of about 135 degrees.

9. An electrical connector assembly according to claim 1, wherein the lug connector has a longitudinal axis extending from the flat end to the barrel connector end and wherein the flat end and the barreled end are angularly disposed to each other and form an angle of about 90 degrees.

10. An electrical connector assembly according to claim 1, wherein the angle connector further comprises either a second male pin or a second compression fitting.

11. An electrical connector assembly according to claim 10, wherein the first and second compression fittings or the first and second male pins are on different surfaces and are about 180 degrees apart.

12. An electrical connector assembly according to claim 1, wherein the angle connector further comprises a second male pin and a second compression fitting.

13. An electrical connector assembly according to claim 12, wherein the first and second male pins are on different surfaces and are about 180 degrees apart.

14. A kit of parts for an electrical connector assembly comprising:

an angle connector comprising a body having six substantially flat surfaces for connections with at least two of the surfaces being in orthogonal relationship, a first male pin and a first compression fitting extending from the at least two surfaces; and a plurality of lug connectors comprising a barrel portion and a flat connection end, wherein the barrel portion of each lug connector is adapted to insertably accommodate the male pin and is compressed for mechanical and electrical engagement between the lug connector and the angle connector, and wherein the flat connection ends of each of the lug connectors extend at mutually distinct angles from the barrel portions.

15. An electrical connector assembly comprising:

a lug connector comprising a flat end having a flat end connector with at least one aperture and a barreled end having a barrel connector; and an angle connector comprising a body having six substantially flat surfaces for connections with at least two of the surfaces being in orthogonal relationship, a first male pin and a first compression fitting extending from the at least two surfaces;

wherein the barrel connector rotatably accommodates the first male pin to provide angular flexibility to the lug connector prior to crimping of the barrel connector about the pin, thereby mechanically and electrically engaging the lug connector to the angle connector.

* * * * *